US006837387B2

(12) United States Patent
De La Fuente

(10) Patent No.: US 6,837,387 B2
(45) Date of Patent: Jan. 4, 2005

(54) MODULAR PRODUCT DISPLAY

(75) Inventor: Ramon De La Fuente, Col. Cove (MX)

(73) Assignee: Sabritas, S.De R.L. De C.V., Mexico (MX)

( * ) Notice: Subject to any disclaimer, the term of this patent is extended or adjusted under 35 U.S.C. 154(b) by 0 days.

(21) Appl. No.: 10/281,315

(22) Filed: Oct. 28, 2002

(65) Prior Publication Data

US 2003/0085189 A1 May 8, 2003

(30) Foreign Application Priority Data

Oct. 26, 2001 (MX) ..... PA/a/2001/010908

(51) Int. Cl.[7] ..... A47F 5/14
(52) U.S. Cl. ..... 211/181.1
(58) Field of Search ..... 211/181.1

(56) References Cited

U.S. PATENT DOCUMENTS 3,680,712 A * 8/1972 Jurasek ..... 211/59.2
3,915,097 A * 10/1975 Young, Jr. ..... 211/181.1
3,977,529 A * 8/1976 Stroh ..... 211/181.1
4,313,544 A * 2/1982 Ashton ..... 211/181.1
5,240,124 A * 8/1993 Buday ..... 211/59.2
D398,460 S * 9/1998 Gerstner ..... D6/463
5,996,812 A * 12/1999 Sokol, Jr. ..... 211/181.1
6,328,170 B1 * 12/2001 Lee ..... 211/59.2
2002/0130098 A1 * 9/2002 Simard ..... 211/181.1

* cited by examiner

*Primary Examiner*—Peter M. Cuomo
*Assistant Examiner*—Erica B. Harris
(74) *Attorney, Agent, or Firm*—Birch, Stewart, Kolasch & Birch, LLP

(57) ABSTRACT

A modular product display is formed from a first upper module and one or more intermediate modules supporting a plurality of exhibiting grates. The grates may include a grate sliding system to facilitate, i.e., restocking and which helps to keep the exhibited products the frontal part of the grate display so a consumer may easily reach the products contained in the modular product display.

13 Claims, 7 Drawing Sheets

MODULAR PRODUCT DISPLAY

BACKGROUND OF THE INVENTION

One of the most important aspects within the industry of manufacturing and distributing edible products such as crackers, appetizers, fritters, bread, tidbits and the like, is the way that such products are displayed to consumers at the sale points.

It is desirable that the display of edible products is done in such a way that such products are always within reach of the consumer and remain orderly placed and classified within the display, and furthermore that such display structure be plain and sturdy so that it may be fitted within the designated physical space where it is placed. Assembly should be easy and it should have versatile characteristics so that storing capacity variations can be made, while a fast substitution and supply of displayed products can be performed by the delivery personnel.

Market studies have shown that sales of a product increase significantly when such products are permanently "in front", that is, that products are always placed at the front of a display, in such a manner that the consumer attention is drawn to them and they can easily be taken from the display.

Several types of displays are known for edible products which usually consist of a series of racks and shelves with divisions to arrange in rows the different products to be displayed for sale. However, such displays do not maintain products in front and at the same time supply labor is hampered by the delivery persons.

Another type of known display is the one published in the Mexican patent application number 9603837, which has the advantage of maintaining products in an orderly manner and permanently in front of the display, furthermore making it ease the placement labor by the delivery people. Nonetheless, in spite of its advantages, such display consists of a relatively complicated structure whereby all the racks in the display are jointly displaced upwards and downwards and products are placed on predetermined size trays which limit placing different size products on the display. On the other hand, due to the structural characteristics of this display, it would certainly be difficult to easily assemble and disassemble which would complicate its transportation and distribution to the sale points.

Another type of known display is the one published in the Mexican patent application number 9603837, which has the advantage of maintaining products in an orderly manner and permanently in front of the display, furthermore making I the placement labor by the delivery people easy. Nonetheless, in spite of its advantages, such display consists of a relatively complicated structure whereby all the racks in the display are jointly displaced upwards and downwards and products are placed on predetermined size trays which limit placing different size products on the display. On the other hand, due to the structural characteristics of this display, it would certainly be difficult to easily assemble and disassemble which would complicate its transportation and distribution to the sale points.

None of the previously conceived devices solves the existing ongoing problem of supplying a display that is capable of modifying its storing capacity, that can be assembled easily by anybody assigned to the task, and that can be easily fitted into a physical determined space, while the exhibition grates allow easy reloading and counting of displayed products. The present invention provides a modular display of products from a simple and sturdy structure. A modular configuration allows the variance of its storing capacity as well as its dimensions in such a way that it can be adapted to any physical space that is assigned for its placement at the sale point and which can be assembled by any person, while the sliding system of the display grates allows fast and effective product supplying and counting.

INVENTION OBJECTS

A feature of the present invention is that it provides a modular product display of sturdy and simple configuration, in such a manner that it can be easily transported and assembled at the sale point by any person to whom the task is assigned.

Another feature of the present invention is that it provides a modular product display that as a result of its modular configurations, allows modification of its storing capacity of products to be displayed.

The present invention also provides a modular product display that is capable of adapting itself to the physical space assigned for its installation.

Another feature of the present invention provides a modular product display that comprises a sliding system for display grates, such that these can rapidly and easily slide by means of simple attachment elements that support intensive use at sale points resulting in optimum operation throughout time.

A structure according to the present invention to provide a modular product display that maintains displayed products in front and in order, notwithstanding their gradual removal from the display.

An advantage of preferred embodiments of the present invention is provision of a modular product display that propitiates delivery, counting and arrangement procedures of products at the sales point.

These and other features and advantages of the invention will be evident by the following drawings and detailed preferred embodiments description.

PREFERRED EMBODIMENT DESCRIPTION

Figure 1:
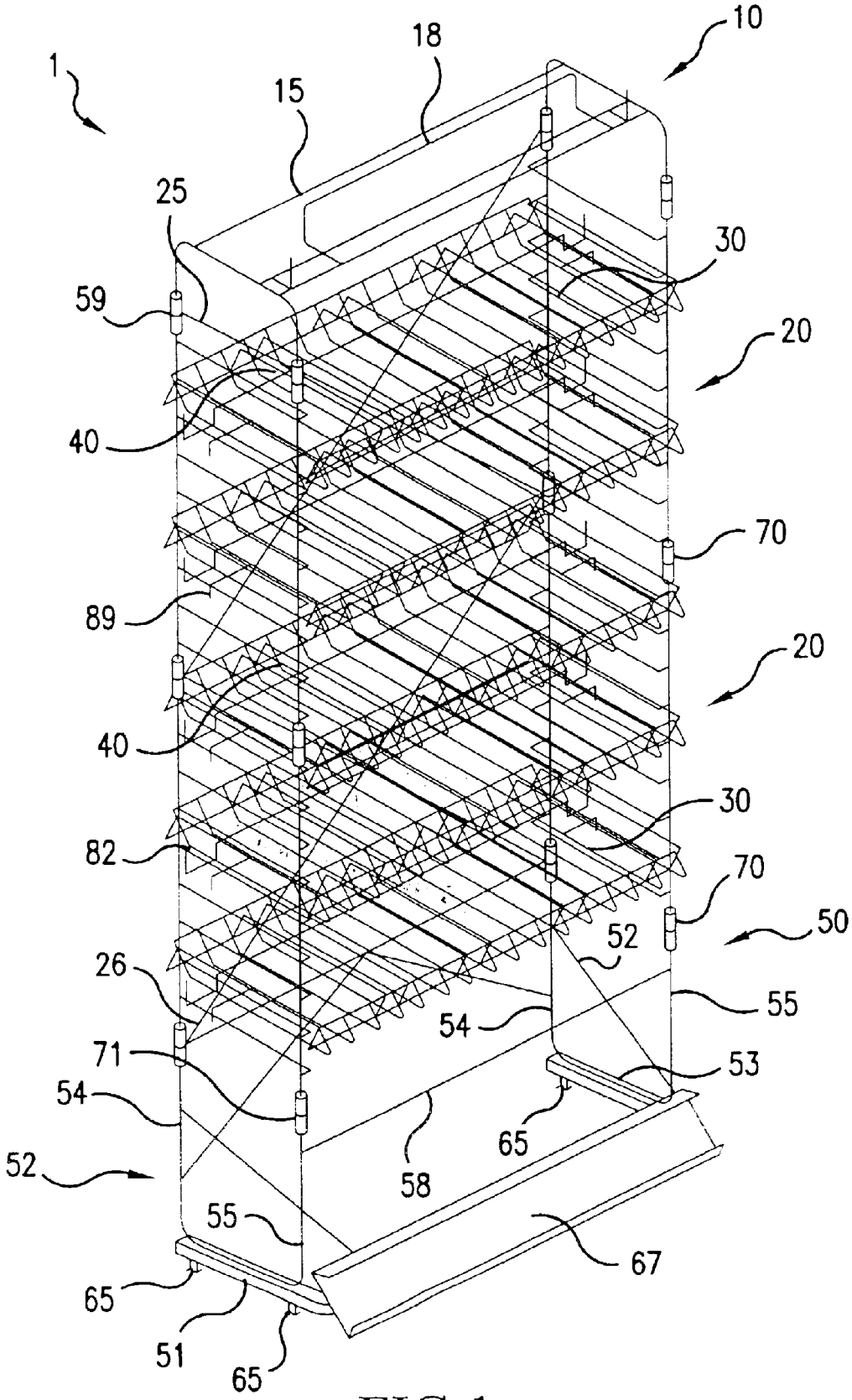
FIG. 1 is a perspective view of the modular product display of the present invention.

Referring to FIGS. 1 to 12, modular product display 1 is illustrated as being formed from an upper module 10, adequate to place decorating or advertising elements; and one or more intermediate modules 20 that support a plurality of display grates 30. Grates 30 comprise a grate sliding system such that forward sliding of goods is propitiated to perform displayed products reloading and counting and backwards to remain in the products display position. Each of the display grates 30 can comprise a respective sliding comb 40 that helps to maintain displayed products in front and ordered, that is, on the front part of grate 30, so that they are within sight and reach of a consumer. The display further includes a lower module 50 which serves as base of modular products display 1 which furthermore can serve to place decorating or advertising elements.

Figure 2:
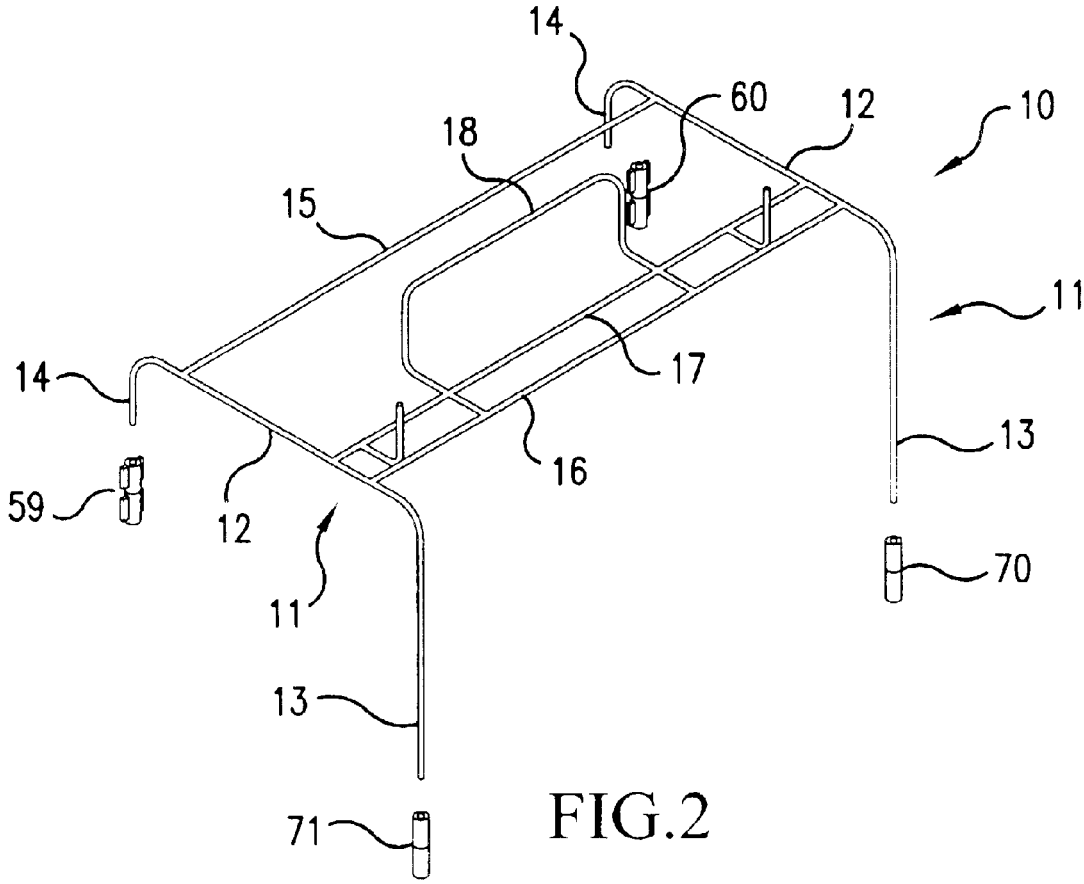
FIG. 2 is a perspective view of the upper modular product display of FIG. 1.

The modular products display 1 is formed from an upper module 10, one or more intermediate modules 20 and a lower module 50, such modules being attached by using connecting nodes, as illustrated in FIG. 2 of the preferred embodiment, utilizing two rear nodes 59–60 and two front nodes 70–71.

The above results in a modular product display 1 easy to assemble, from a simple and sturdy configuration and which is easily adapted to designated physical installation space Display capacity can be varied by adding or deleting intermediate modules 20 from modular display 1. The distance between each of the displaying grates 30, at intermediate module 20, can be varied in order to adapt to displaying products of differing dimensions.

Figure 3:
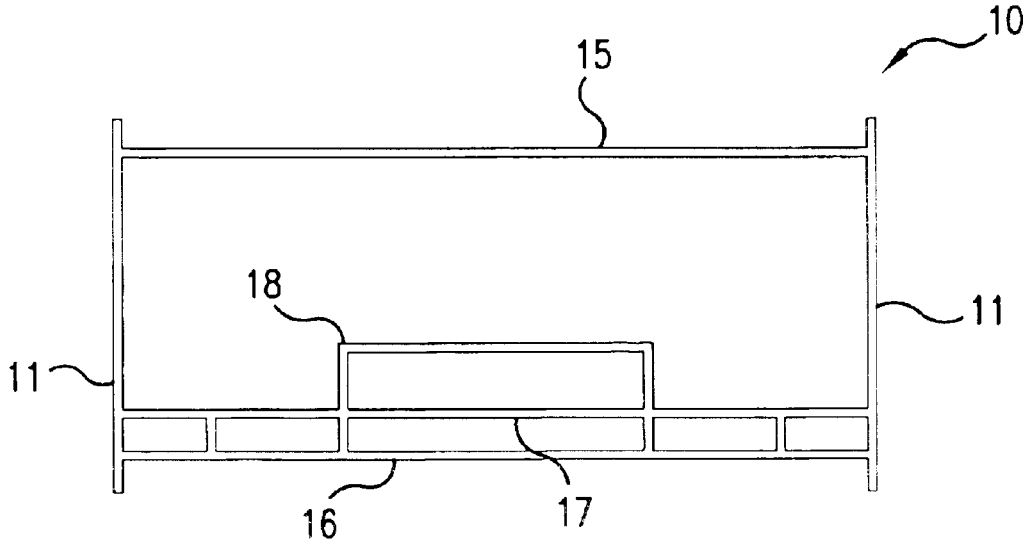
FIG. 3 is a plan view of the upper module display of FIG. 1.

Upper module 10 used to place decorative or advertising elements, shown on FIGS. 1, 2, and 3, comprises two reversed "L" shaped structural elements 11, defining such upper module 10 body, wherein each of the elements 11 is formed from a three-part sectioned rod, such that a central portion 12 is defined as horizontally arranged with respect to the modular display 1 base, one front end portion 13 forming a right angle with respect to central portion 12 and which has a greater length than the rear end portion 14, which also forms a right angle with respect to the central portion 12, such that portions 13 and 14 remain parallel and separated by central portion 12. On end portions of said elements 13 and 14 posterior connecting nodes 59–60 and frontal 70–71 are placed, which couple upper module 10 with next module 20.

One or more intermediate modules 20, shown on FIGS. 1, 4, 5, 6 and 7, can be included in modular display 1 inasmuch as the quantity of included intermediate modules 20 defines the storing capacity and height of products modular display 1.

Figure 4:
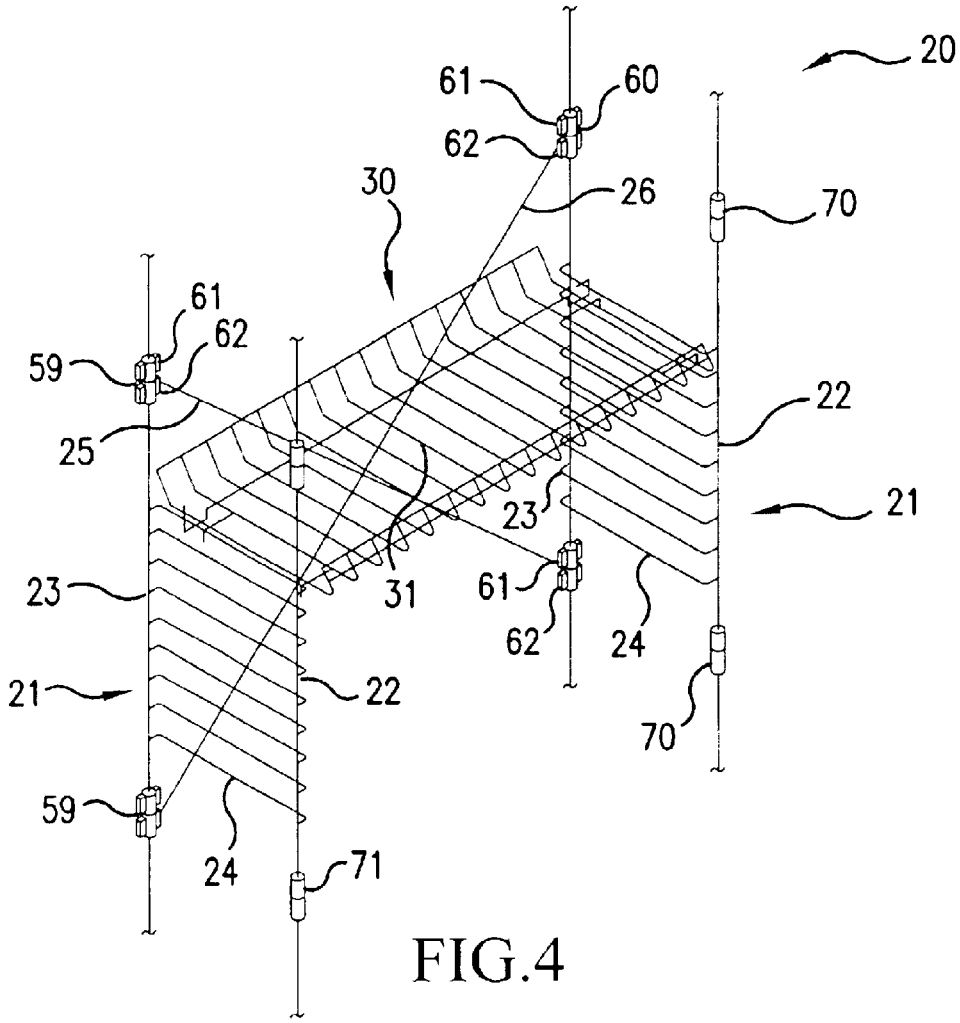
FIG. 4 is a perspective view of an intermediate module display of FIG. 1, including a display grate.
Figure 5:
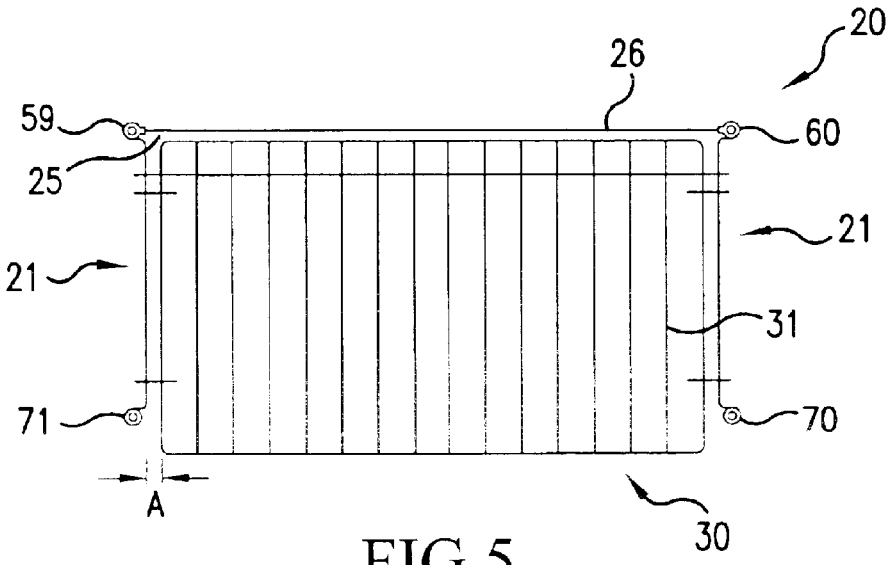
FIG. 5 is a plan view of an intermediate module display of FIG. 1, including a display grate.
Figure 6:
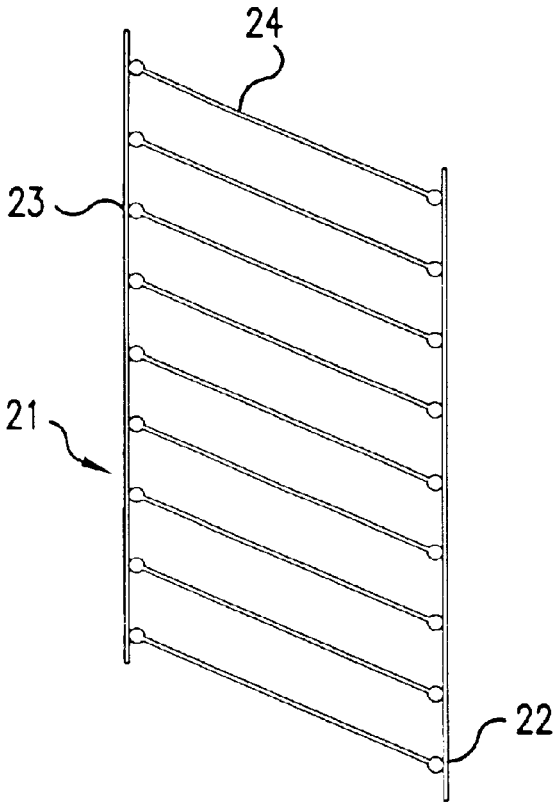
FIG. 6 is an elevated front view of the intermediate module left side element of FIG. 4.
Figure 7:
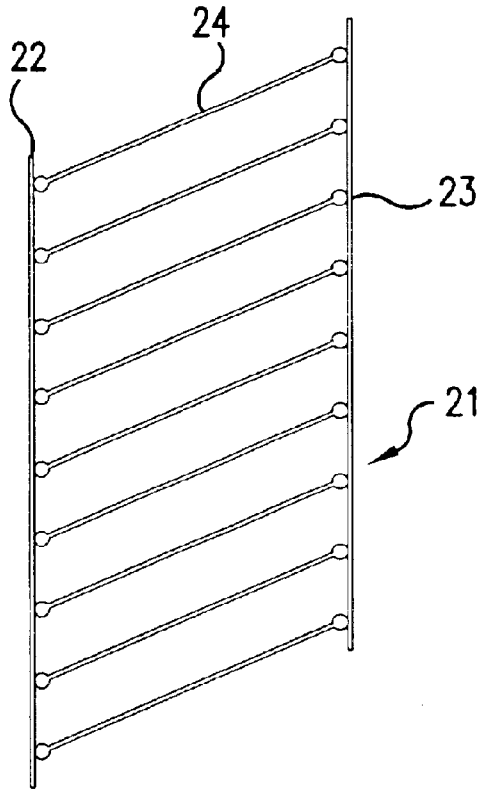
FIG. 7 is an elevated front view of the intermediate module right side element of FIG. 4.
Figure 8A:
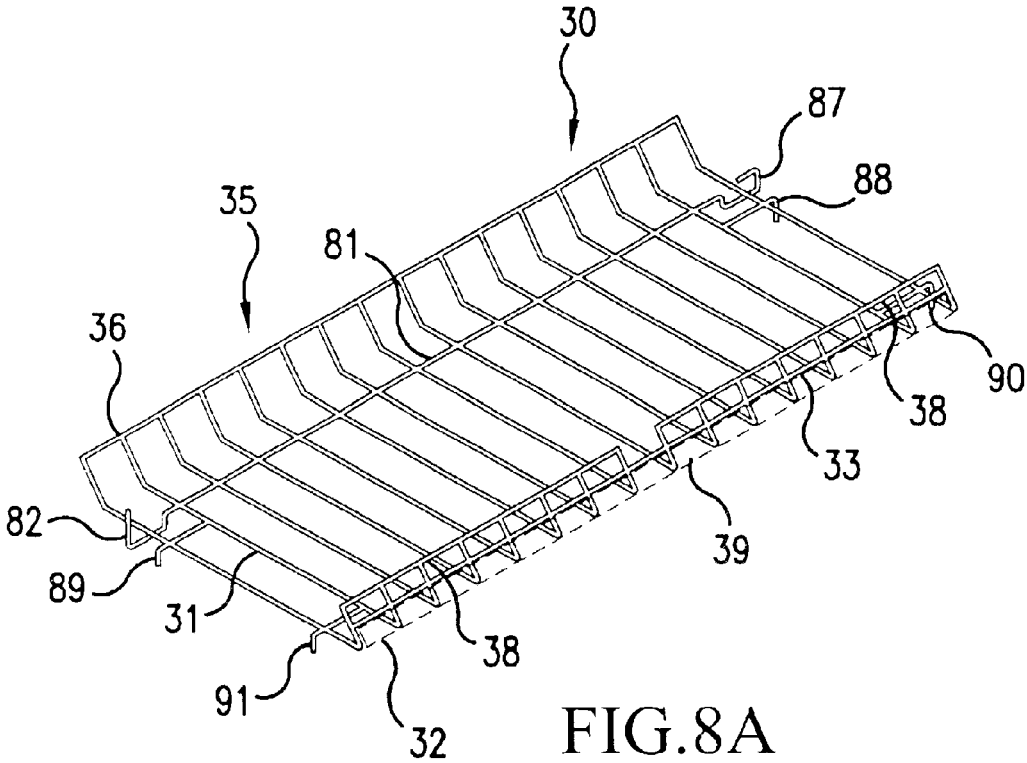
FIG. 8A is a perspective view of a display grate.
Figure 8B:
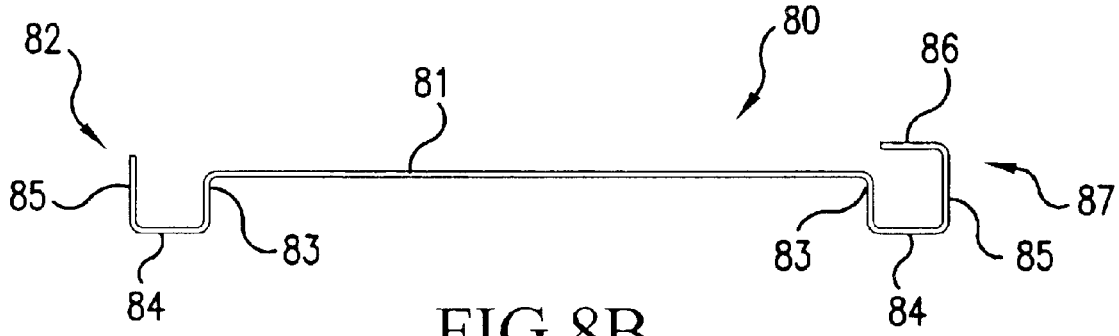
FIG. 8B is an elevated front view of the display grate sliding system first fastening element.
Figure 8C:
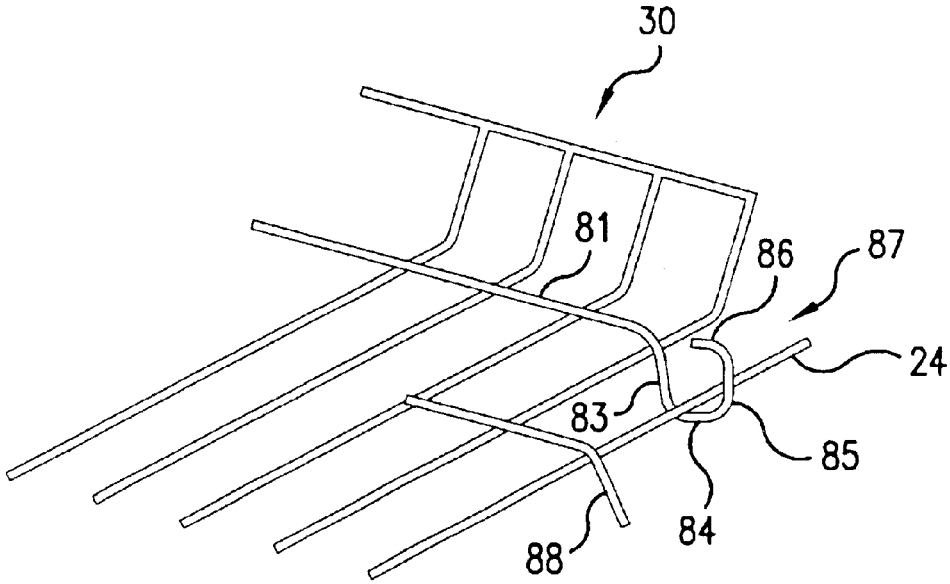
FIG. 8C is a detailed view of fastening elements joined to side elements of FIG. 7.

Intermediate module 20 shown on FIGS. 1, 4, 5, y and 7, can be present on products modular display 1 one or more times, inasmuch as the quantity of included intermediate modules 20 defines the storing capacity and height of products modular display 1.

Each of modules 20 is formed from two lateral elements 21 denominated flags, and two tension members 25 and 26 disposed on a posterior portion of said flags 21. Tension members 25 and 26 are diagonally coupled through cavities formed on two hollow circular projections, upper 61 and lower 62, from posterior connecting nodes 59–60 in such a way that, with these tension members 25 and 26, structural rigidity needed for optimal operation of said intermediate modules is achieved.

Flags 21 comprise two parallel straight rods, frontal 22 and posterior 23, which have the same length, posterior rod 23 being dephased with respect to frontal rod 22 as a consequence of the inclination angle on which a plurality of slanted rods 24 are placed and joined to said frontal and posterior rods 22 and 23. Slanted rods 24 have the function to support the plurality of exhibiting grates 30, wherein each of slanted rods 24 have a "U" shape so its ends are joined to frontal and posterior rods 22 and 23, leaving a free space A in such a way that easy displacement of exhibiting grates 30 forward and backward is allowed.

Rods 24 have a slanting angle with respect to rods 22 and 23 form between 15° and 45°, approximately, so that when grates are placed on their exhibiting position, products slide towards the front part of display.

Similarly, as on upper module 10, the intermediate module or modules 20 are joined to next module and the preceding module through posterior connecting nodes 59–60 and frontal nodes 70–71, placed on each of rods 22 and 23 end portions which integrate flags, respectively.

As illustrated on FIGS. 4 and 5, module 20 has the capacity to receive a plurality of exhibiting grates 30, although only one of them is shown. Exhibiting grate 30 is shown with more detail in FIG. 8, wherein it can be appreciated that the same is configured from a plurality of parallel rods 31, conveniently placed to form a grate, a frontal wall 32 and a posterior wall 35. The frontal wall 32 is formed from an upwards and inwards projection of each rod 31 integrating the plurality of rods 31 and which forms exhibiting grate 30. The slanting angle of the projection of frontal wall 32 is conveniently between 50° and 60° with respect to the plane defined by the plurality of rods 31, projections being limited by a rod 33 which is disposed perpendicularly to the plurality of rods 31. Exhibiting grate 30, on its posterior wall 35, being defined by a projection upwards and outwards of the plurality of rods 31, in such a way that the slanting angle of said posterior wall 35 protection is conveniently between 120° and 130° with respect to the plane defined by the plurality of rods 31. A rod 36 is provided which does the same function as rod 33 on frontal wall 32. The distance comprised between limiting rods 33 and 36 defines the capacity of products which can be stored on exhibiting grate 30. Additionally, exhibiting grate 30 comprises over its frontal wall 32, two inverted "U" shaped elements 38 which are joined on their free ends to the frontal limiting rod 33 of the plurality of rods 31 from grate 30, thus achieving to increase height of frontal wall 32 so as to allow to firmly retain the products which are exhibited on said exhibiting grate 30.

A Over frontal wall 32 of grate 30, there is a sheet 39 (shown in dashed lines), the upper margin of which is matched with the limiting rod 33 of the plurality of rods 31. The lower margin of said sheet 39 can be suspended under the plane defined by the plurality of rods 31 from the exhibiting grate 30, wherein said sheet 39 serves to place decorative or advertising information thereon.

As previously mentioned, exhibiting grate 30 also includes a sliding system which allows grates to move forward and backwards in order to place said grate in its exhibiting position or in its products supplying position. As can be seen with greater detail on FIGS. 8B and 8C, said sliding system comprises a first fastening element 80 which is disposed on a back part of grate 30, near the point where the plurality of rods 31 project to form posterior wall 35 and under grate 30. First fastening element 80 is formed from a straight rod 81, which is perpendicularly disposed with respect to the plurality of rods 31, projecting outwards the two end-most rods 31. Each of the ends of the fastening element 80 presents joining elements to join exhibiting grate 30 to one of the rods 24 from flags 21. On one of the extremities of fastening element 80, there is a disposed a first joining element 82 configured from an "U" shaped projection that has a first portion 83 downwards as a continuation on the end of straight element 81, a second portion 84 parallel to straight element 81, and a third portion 85 upwards, with respect to straight segments 81 and 84, the length of which exceeds the dimension defined by the plurality of rods 31 of exhibiting grate 30. In this way, joining element 82 is fastened from bottom to top to one of the rods 24 from flags 21. The opposite end of fastening element 80 presents a second joining element 87 from exhibiting grate 30 for engaging one of the rods 24 from flags 21, wherein said joining element 87 presents a configuration similar to the one from joining element 82. Element 87 also presents a downwards projection 83, a straight segment 84 parallel to straight element 81, and an upwards projection 85 with respect to straight segments 81 and 84, and further includes an additional projection 86 horizontal towards first joining element 82 which slightly exceeds the plan defined by the plurality of rods 31 from exhibiting grate 30, in such a way that the configuration of second joining element 87 provides a hook shaped latch which prevents element 87 from easily separating from the rod 24 of the flag 21 elements to which it is fastened.

To complement, in said sliding system there are four "L" shaped supporting elements disposed, two on the posterior part 88–89 and two on the frontal part 90–91, on each side of grate 30, which are fastened under penultimate and ultimate rods from the plurality of rods 31 of exhibiting grate 30. Each of said joining elements 88–91 are fixed to the exhibiting grate, parallel to one another, and with respect to fastening element 80, and each has a shorter length arm projecting downwards, so that when placing exhibiting grate 30 over one from the plurality of rods 24 from flags 21, the grate rests over elements 88–91 on the portion near their downward projections. Joining elements 90–91 disposed near the frontal wall 32 of the exhibiting grate 30, thus accomplishing the frontal support function over one of the plurality of rods 24 from flags 21, and also retain exhibiting grate 30 in its exhibiting position once the joining elements 90–91 bump against the frontal section of the "U" formed on each of the rods 24, joined to straight bar 22 from flag 21.

With the previously described system, it can be easily appreciated that the form and disposition of the joining elements 82, 87 and 88–91, as well as the reduced contact surface between each of the elements of the system, allows for easy and fast sliding of the exhibiting grate over the plurality of rods 24 of flags 21, from an exhibiting position to a supplying position. The grate may move forward once the grate 30 is slightly lifted in order to raise joining elements 90–91 over the "U" shaped plurality of rods 24, joined to the straight rod 22 of flag 21.

Figure 9:
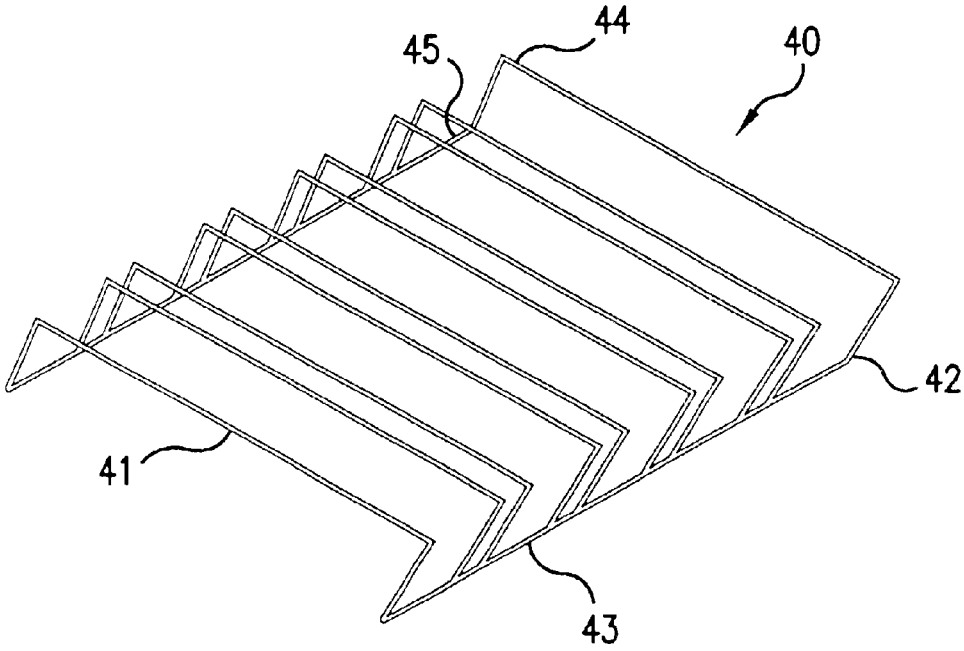
FIG. 9 is a perspective view of a display grate sliding comb.
Figure 10:
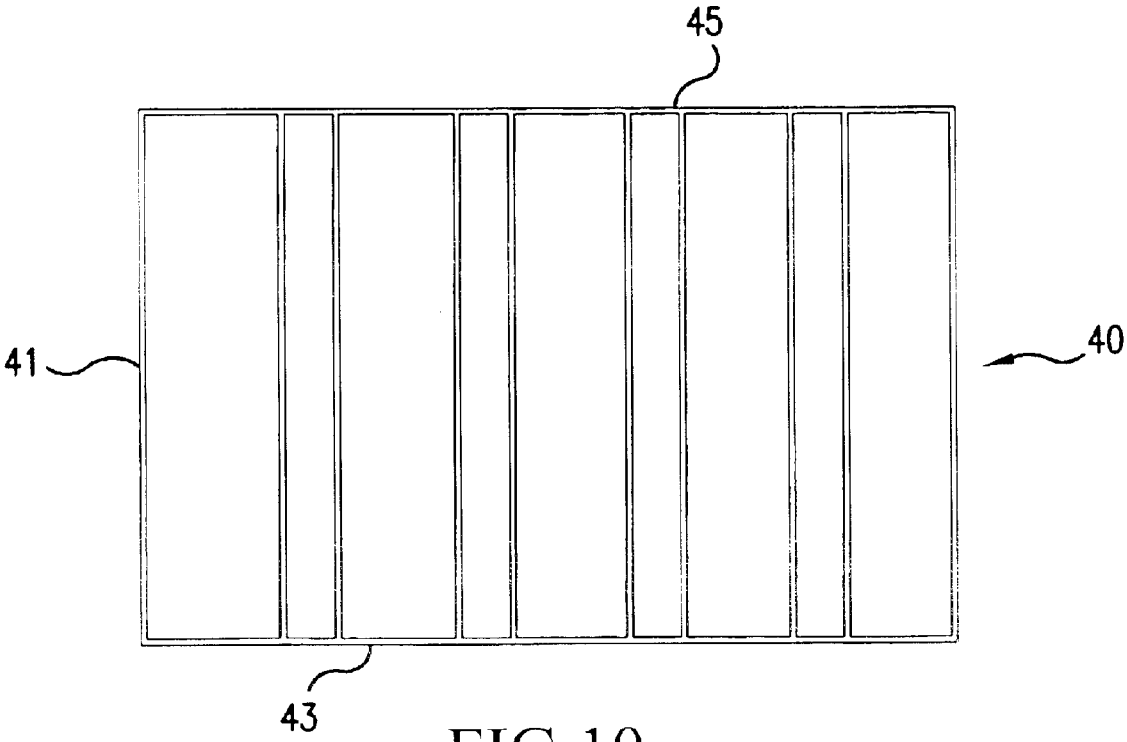
FIG. 10 is a plan view of a display grate sliding comb of FIG. 9.

Exhibiting grates 30 can additionally incorporate a sliding comb 40, which consists of a plurality of rods 41 placed on a two by two arrangement, except for the end-most rods, which are individual, such as it is appreciated on FIGS. 9 and 10. Sliding comb 40 arrangement is conceived in order to allow the products exhibited on exhibiting grate 30 to easily slide towards its frontal part once the grate is placed on its exhibiting position. The rods 41 present on one of their ends, a projection 42, downwards and inwards, each of the rods comprising the sliding comb 40 being joined by means of a rod element 43 which is perpendicularly disposed with respect to each one of the tips of the sliding comb 40 rod. The plurality of rods 41 on the opposite end present a projection downwards and outwards 44, which are joined by means of a rod element 45 that is perpendicularly disposed with respect to each one of the tips of the sliding comb 40 rods. In this way, sliding comb 40 may be properly coupled over exhibiting grate 30 on the start points from frontal and posterior walls 32 and 35, thus guaranteeing that exhibited products are always found at the front part of the exhibiting grates 30.

Figure 11:
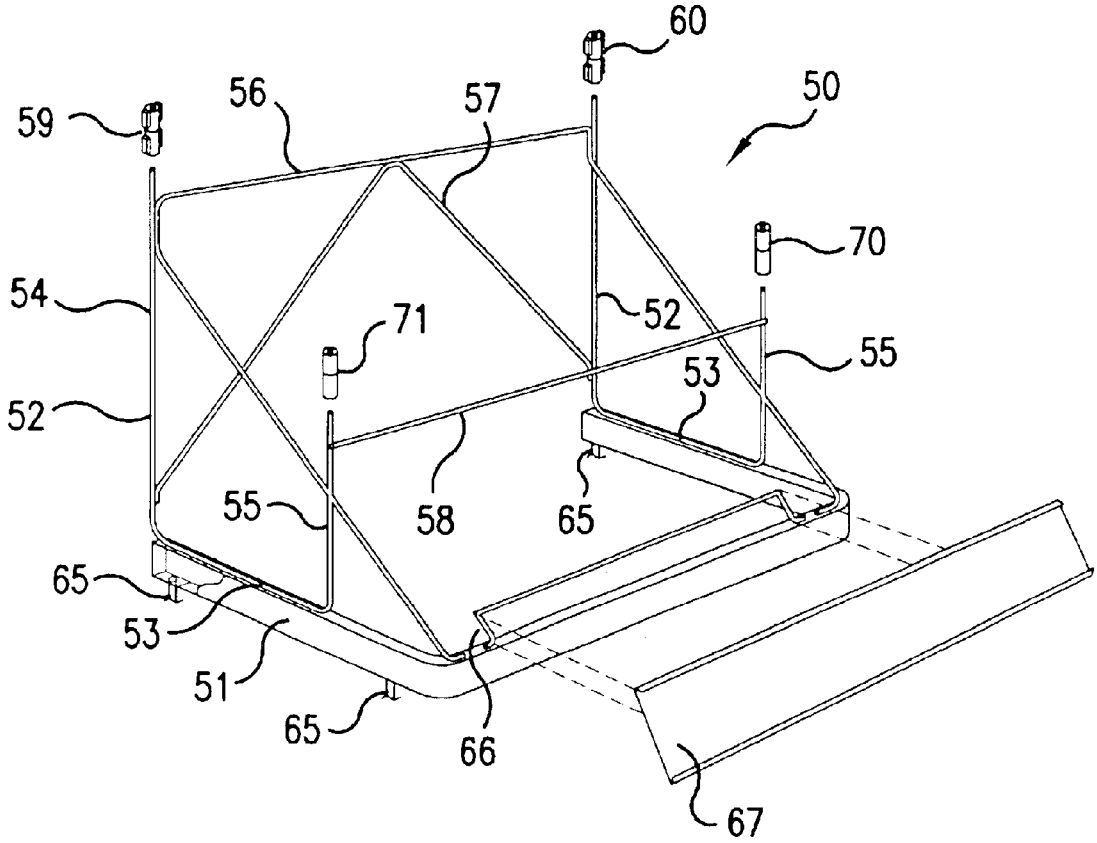
FIG. 11 is a perspective view of the display base module of FIG. 1.
Figure 12:
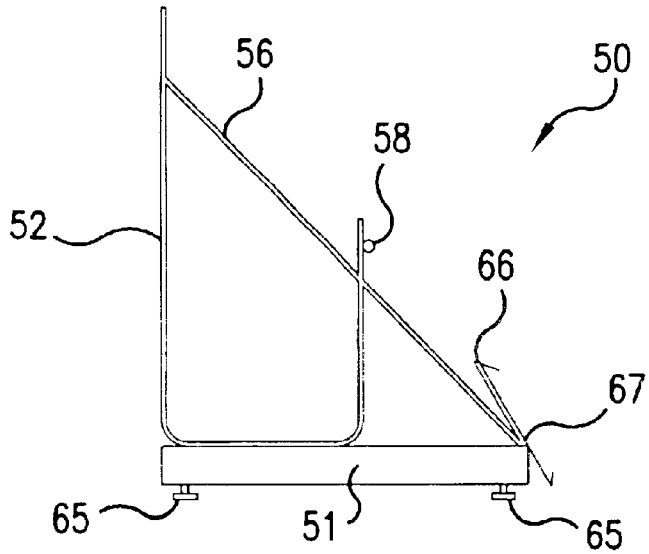
FIG. 12 is an elevated side view of the display base module of FIG. 1.

On the other hand, base module 50 from products modular display 1, shown on FIGS. 1, 11, and 12, is conformed by a first "U" shaped element 51, which is manufactured from a rectangular section material. "L" shaped structural elements 52 are placed over its upper face and on each one of the arms from its free end defining, in combination with element 51, said base module 50 body, wherein each of the elements 52 is formed from a three-sectioned rod, in such a way that there is a central portion 53 horizontally disposed with respect to the modular display 1 base, and two end portions 54 and 55 at a right angle with respect to central portion 53. First end 54 presents a length greater than the one of second portion 55 from structural element 52, so that they are kept parallel and separated by central element 53. End parts of said elements 54 and 55 are appropriate to place posterior connecting nodes 59–60 and frontal connecting nodes 70–71 which allow joining of this base module 50 with intermediate module 20 which precedes it. Additionally, said base module 50 comprises rods 56 and 57 the configuration of which allows, in combination with a straight rod 58, to define separation between the two structural elements 52 and to give the needed rigidity to support modules weight which are placed thereon.

Likewise, base module 50 comprises a levelling mechanism 65 formed by a solepiece transversally disposed with respect to posterior face of "U" shaped element 51, which presents on its center a threaded bore, wherein a screw is threaded allowing to level modular display 1 in order to keep it horizontal with respect to the plan wherein it is located in spite of the surface irregularities on which it is placed. So that base module 50 integrates four levelling mechanisms 65 disposed over posterior face of "U" shaped element 51 on each one of the arms ends of said element 51. Finally, base module 50 also comprises an element 66 which is formed from an inverted "U" shaped structure tilted towards main body of base module 50, on which free ends, and as part of the same structure, there are placed on straight angle with respect to free ends two segments joining said structure with central portion of "U" shaped element 51 on its upper face, this in order to give rigidity to element 66 so that it can sustain sheet 67 disposed on its frontal part, which serves to house advertising or decorative elements thereat.

What is claimed is:

1. A product display comprising:

a pair of side supports, each side support comprising a pair of substantially vertical members, and a plurality of parallel U-shaped rods extending between said vertical members, said U-shaped rods extending in a direction inclined from horizontal;

a plurality of exhibiting grates, each grate including a pair of lateral support elements at each end thereof, said lateral support elements engaging top surfaces of a pair of said U-shaped rods to support said grate on said U-shaped rods;

at least one of said support elements engaging a part of a respective U-shaped rod to maintain said grate in a display position; and said at least one support element disengaging said part of said respective U-shaped rod when said grate is shifted to permit said grate to slide along said U-shaped rods to a restocking position.

2. A product display as in claim 1, wherein each grate comprises two forward support elements and two rearward support elements;

said forward support elements engaging part of said U-shaped rods to maintain said grate in a display position;

said forward support elements disengaging said part of said U-shaped rods to permit said grate to slide to a restocking position.

3. A product display as in claim 2, wherein said support elements are L-shaped.

4. A product display as in claim 2 further comprising at least one hook element for retaining said grate on said U-shaped rods.

5. A product display as in claim 2, further comprising at least one hook element generally adjacent a rearward position of each said grate to retain said grate on said U-shaped rods in both said display position and said re-stocking position.

6. A product display as in claim 5, comprising a pair of hook elements generally adjacent said rearward supporting elements.

7. A product display as in claim 6, wherein said hook elements engage lower surfaces of said U-shaped rods.

8. A product display as in claim 5, wherein said hook element engages a lower surface of said U-shaped rod.

9. A product display as in claim 1, wherein said support elements are L-shaped.

10. A product display as in claim 1, further comprising a sliding comb associated with at least one grate, said sliding comb comprising a plurality of parallel bars for facilitating sliding of products toward a lower portion of the grate, said parallel bars being joined together by at least one lateral rod.

11. A product display as in claim 1, wherein said U-shaped rods are inclined at an angle between approximately 15 degrees to approximately 45 degrees to horizontal.

12. A product display as in claim 1, further comprising a base module, said base module including vertical elements engageable with said substantially vertical members for supporting said side supports, and a further support for decorative or advertising elements.

13. A product display as in claim 1, further comprising an upper module, said upper module comprising vertical elements for engaging said substantially vertical members of said side supports, and a further support for decorative or advertising elements.

* * * * *